US005560391A

United States Patent [19]

Bantaculo

[11] Patent Number: 5,560,391

[45] Date of Patent: Oct. 1, 1996

[54] HOSE HANDLING APPARATUS WITH SELF-COILING CAPABILITIES

[76] Inventor: Armando A. Bantaculo, 700 Martin's Creek Blvd. #201, Summerville, S.C. 29485

[21] Appl. No.: 529,561

[22] Filed: Sep. 18, 1995

[51] Int. Cl.[6] ..... B65H 75/34

[52] U.S. Cl. ..... 137/355.23; 137/355.26

[58] Field of Search ..... 137/355.16, 355.17, 137/355.23, 355.26

[56] References Cited

U.S. PATENT DOCUMENTS

| | | | |
|---|---|---|---|
| 1,746,995 | 2/1930 | Edwards | 137/355.26 |
| 1,752,048 | 3/1930 | Woodford | 137/355.23 |
| 2,170,281 | 8/1939 | Snow | 137/355.26 |
| 2,403,277 | 7/1946 | Hall | 137/355.26 |
| 2,896,659 | 7/1959 | Erickson | 137/355.23 |

FOREIGN PATENT DOCUMENTS

| | | | |
|---|---|---|---|
| 165458 | 8/1955 | Australia | 137/355.23 |
| 50004 | 11/1939 | France | 137/355.23 |

*Primary Examiner*—A. Michael Chambers

[57] ABSTRACT

A hose handling apparatus comprising a box having an upper horizontal plate in a rectangular configuration having parallel long side edges and a short front edge and a parallel short rear edge. A pair of parallel vertical side plates extend downwardly from the side edges of the upper plate and with front and rear vertical plates extending downwardly from the front and rear edges of the upper plate. A pair of axially aligned circular apertures are formed in a central extent of the side plates. A spindle has a pair of spaced aligned disk-shaped shoulders and a hollow core therebetween and with a projecting short tube extending from one end of the spindle rotatably mounted in one of the aligned apertures and with a projecting long tube extending from the other end of the spindle rotatably mounted in the other of the aligned apertures to journal the spindle within the housing. The long tube has a rotatable bearing with threads at its outboard end for coupling with a source of water and having coupling components at its inboard end for being coupled to a hose mounted on the core. A spring around the short tube couples the adjacent shoulder with the short tube and resiliently urging the spindle core and a hose thereon to a wound orientation. An aperture is formed in the front wall with a pair of spaced rollers for guiding the movement of a hose between the spindle and exterior thereof.

1 Claim, 3 Drawing Sheets

HOSE HANDLING APPARATUS WITH SELF-COILING CAPABILITIES

BACKGROUND OF THE INVENTION

1. Field of the Invention

The present invention relates to a new and improved hose handling apparatus with self-coiling capabilities and, more particularly, pertains to winding up a hose automatically when not in use.

2. Description of the Prior Art

The use of hose supporting devices of various designs and configurations is known in the prior art. More specifically, hose supporting devices of various designs and configurations heretofore devised and utilized for the purpose of keeping hoses wound when not in use through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of hose supporting devices of various designs and configurations. By way of example, U.S. Pat. No. 4,543,982 to Wolf discloses an automatic rewinding water hose reel.

U.S. Pat. No. 4,513,772 to Fisher discloses an automatic hose reel.

U.S. Pat. No. Des. 328,173 to Nelson discloses a garden hose reel caddy.

U.S. Pat. No. 4,974,627 to Nelson discloses a garden hose reel caddy.

Lastly, U.S. Pat. No. 5,143,392 to Collins discloses a retractable hose system.

In this respect, the hose handling apparatus with self-coiling capabilities according to the present invention substantially departs from the conventional concepts and designs of the prior art, and in doing so provides an apparatus primarily developed for the purpose of winding up a hose automatically when not in use.

Therefore, it can be appreciated that there exists a continuing need for a new and improved hose handling apparatus with self-coiling capabilities which can be used for winding up a hose automatically when not in use. In this regard, the present invention substantially fulfills this need.

SUMMARY OF THE INVENTION

In view of the foregoing disadvantages inherent in the known types of hose supporting devices of various designs and configurations now present in the prior art, the present invention provides a new and improved hose handling apparatus with self-coiling capabilities. As such, the general purpose of the present invention, which will be described subsequently in greater detail, is to provide a new and improved hose handling apparatus with self-coiling capabilities and methods which have all the advantages of the prior art and none of the disadvantages.

To attain this, the present invention essentially comprises a hose handling apparatus comprising a box having an upper horizontal plate in a rectangular configuration having parallel long side edges and a short front edge and a parallel short rear edge. A pair of parallel vertical side plates extend downwardly from the side edges of the upper plate and with front and rear vertical plates extending downwardly from the front and rear edges of the upper plate. Four trapezoidal shaped base plates extend outwardly at an angle from the lower edges of the side, front and rear plates to provide stability to the box. A pair of axially aligned circular apertures are formed in a central extent of the side plates. A spindle has a pair of spaced aligned disk-shaped shoulders and a hollow core therebetween and with a projecting short tube extending from one end of the spindle rotatably mounted in one of the aligned apertures and with a projecting long tube extending from the other end of the spindle rotatably mounted in the other of the aligned apertures to journal the spindle within the housing. The long tube has a rotatable bearing with threads at its outboard end for coupling with a source of water and having coupling components at its inboard end for being coupled to a hose mounted on the core. A spring around the short tube couples the adjacent shoulder with the short tube and resiliently urging the spindle core and a hose thereon to a wound orientation. An aperture is formed in the front wall with a pair of spaced rollers for guiding the movement of a hose between the spindle and exterior thereof.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hose handling apparatus with self-coiling capabilities which has all the advantages of the prior art hose supporting devices of various designs and configurations and none of the disadvantages.

It is another object of the present invention to provide a new and improved hose handling apparatus with self-coiling capabilities which may be easily and efficiently manufactured and marketed.

It is a further object of the present invention to provide a new and improved hose handling apparatus with self-coiling capabilities which is of a durable and reliable construction.

An even further object of the present invention is to provide a new and improved hose handling apparatus with self-coiling capabilities which is susceptible of a low cost of manufacture with regard to both materials and labor, and which accordingly is then susceptible of low prices of sale to the consuming public, thereby making such a hose handling apparatus with self-coiling capabilities economically available to the buying public.

Still yet another object of the present invention is to provide a new and improved hose handling apparatus with self-coiling capabilities which provides in the apparatuses and methods of the prior art some of the advantages thereof, while simultaneously overcoming some of the disadvantages normally associated therewith.

Even still another object of the present invention is to winding up a hose automatically when not in use.

Lastly, it is an object of the present invention to provide a hose handling apparatus comprising a box having an upper horizontal plate in a rectangular configuration having parallel long side edges and a short front edge and a parallel short rear edge. A pair of parallel vertical side plates extend downwardly from the side edges of the upper plate and with front and rear vertical plates extending downwardly from the front and rear edges of the upper plate. A pair of axially aligned circular apertures are formed in a central extent of the side plates. A spindle has a pair of spaced aligned disk-shaped shoulders and a hollow core therebetween and with a projecting short tube extending from one end of the spindle rotatably mounted in one of the aligned apertures and with a projecting long tube extending from the other end of the spindle rotatably mounted in the other of the aligned apertures to journal the spindle within the housing. The long tube has a rotatable bearing with threads at its outboard end for coupling with a source of water and having coupling components at its inboard end for being coupled to a hose mounted on the core. A spring around the short tube couples the adjacent shoulder with the short tube and resiliently urging the spindle core and a hose thereon to a wound orientation. An aperture is formed in the front wall with a pair of spaced rollers for guiding the movement of a hose between the spindle and exterior thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
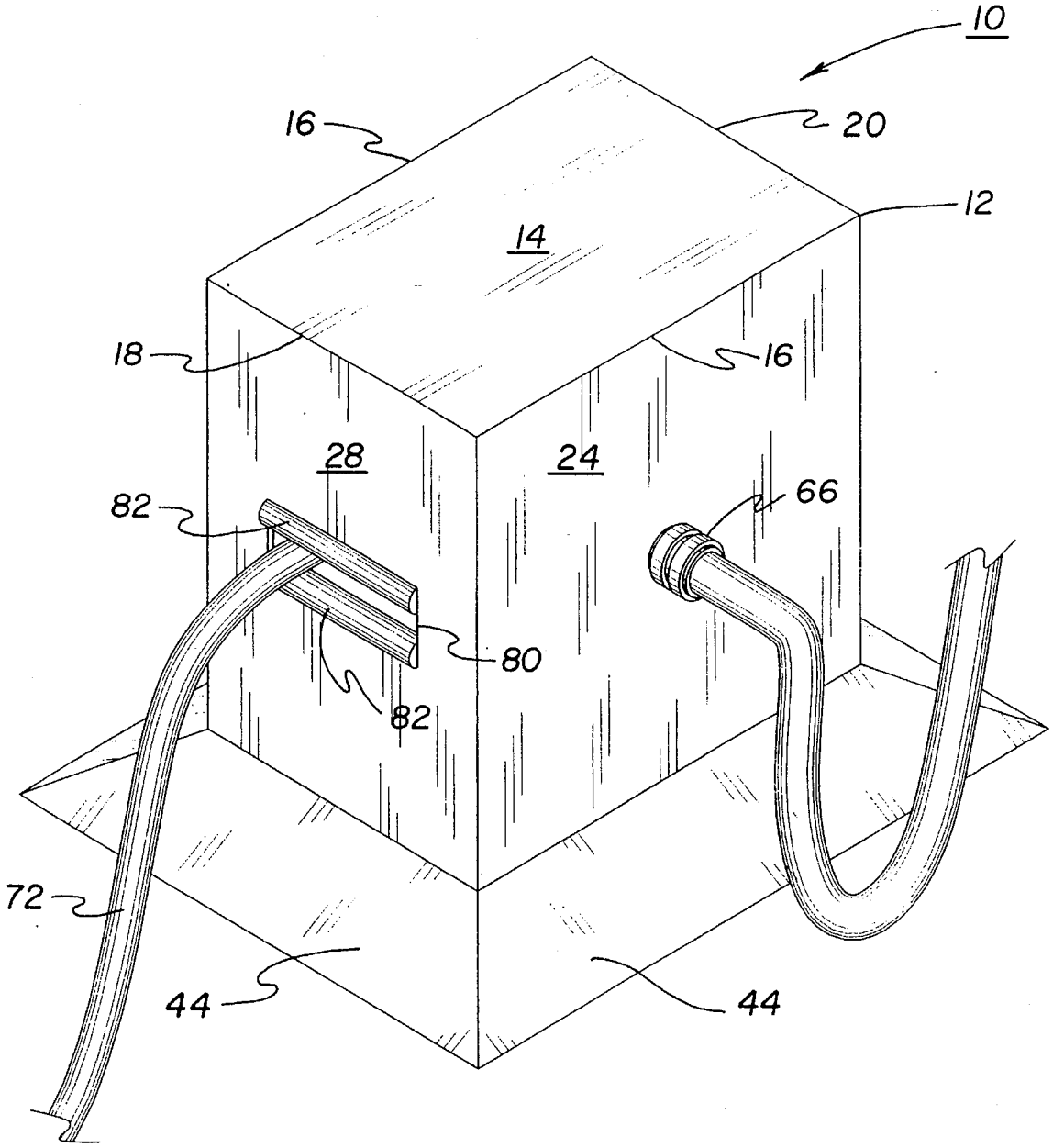
FIG. 1 is a perspective illustration of the preferred embodiment of the hose handling apparatus with self-coiling capabilities constructed in accordance with the principles of the present invention.
Figure 2:
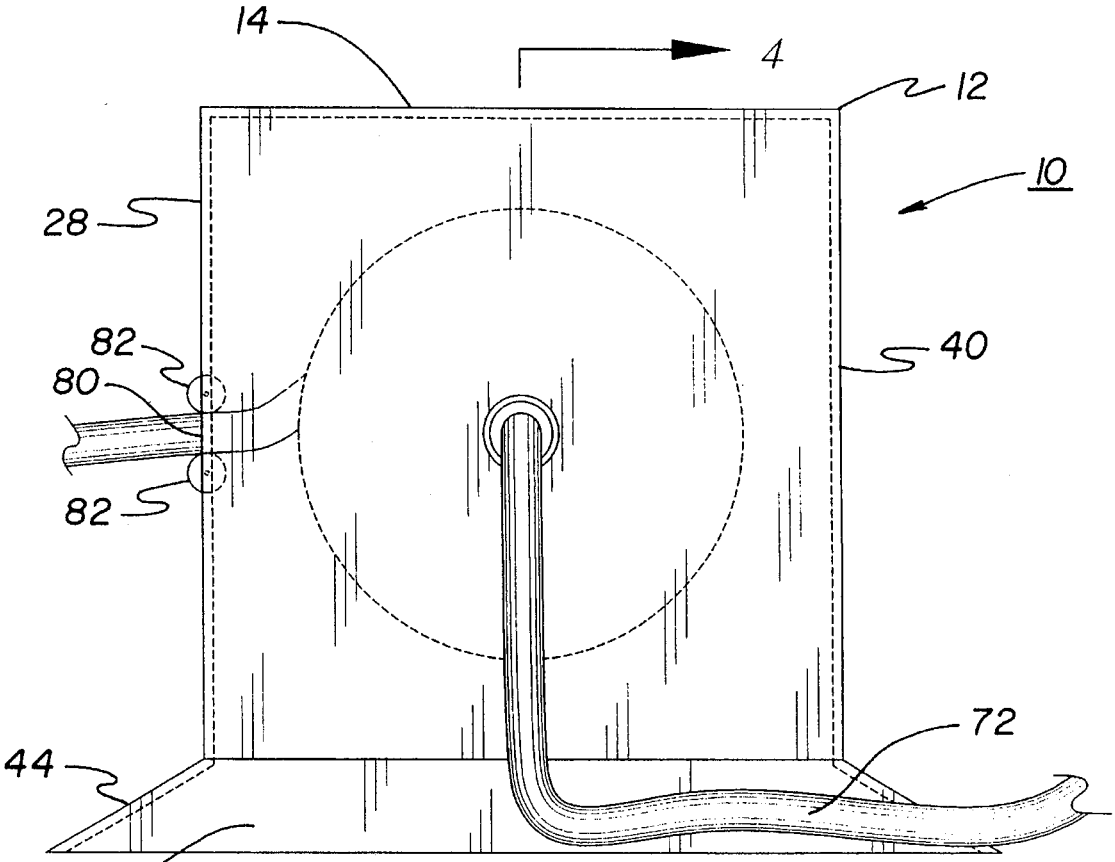
FIG. 2 is a side elevational view of the device shown in FIG. 1.
Figure 3:
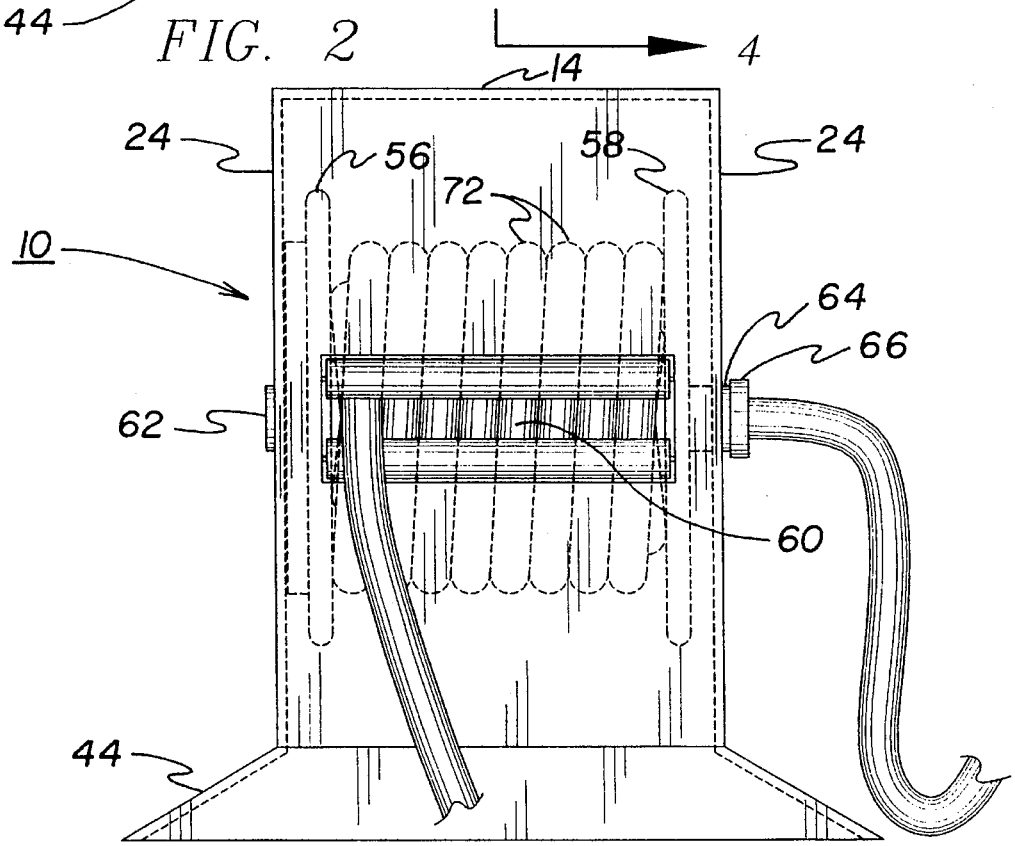
FIG. 3 is a front elevational view of the apparatus shown in FIGS. 1 and 2.
Figure 4:
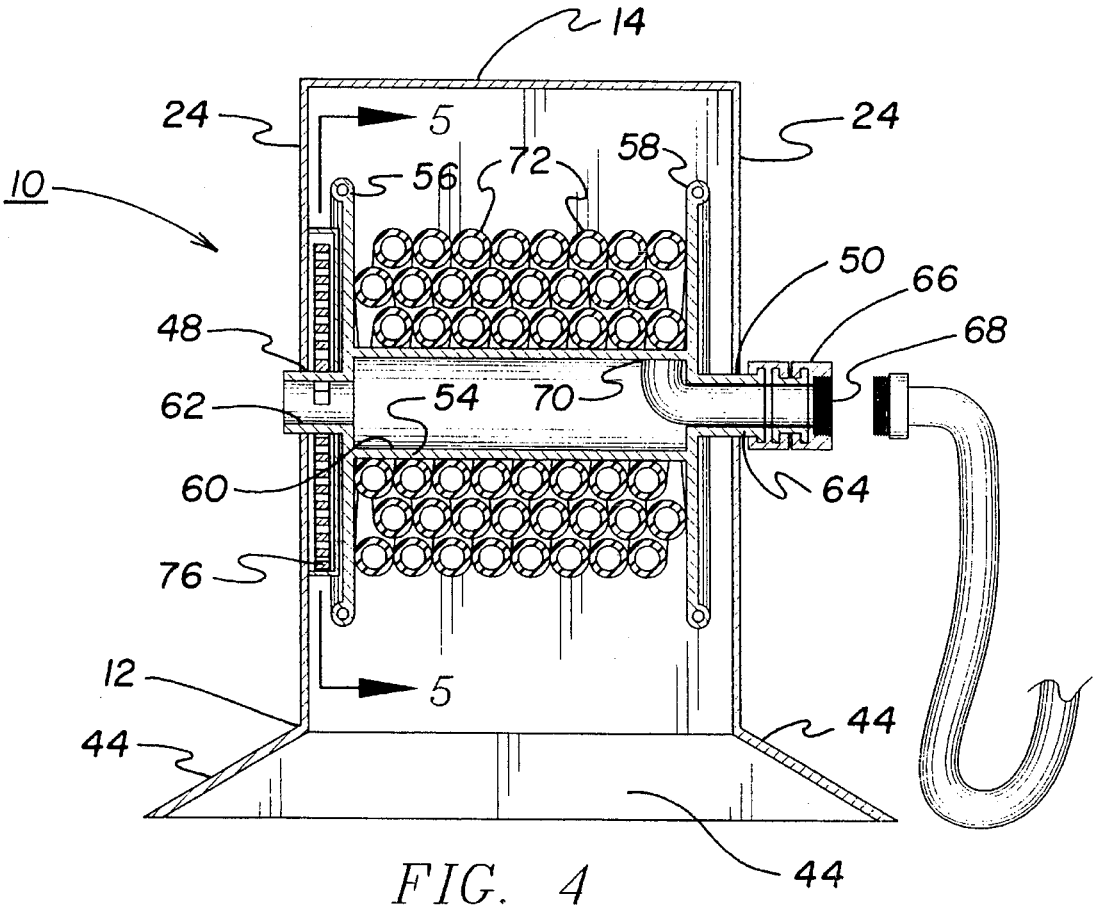
FIG. 4 is a cross sectional view taken along line 4—4 of FIG. 2.
Figure 5:
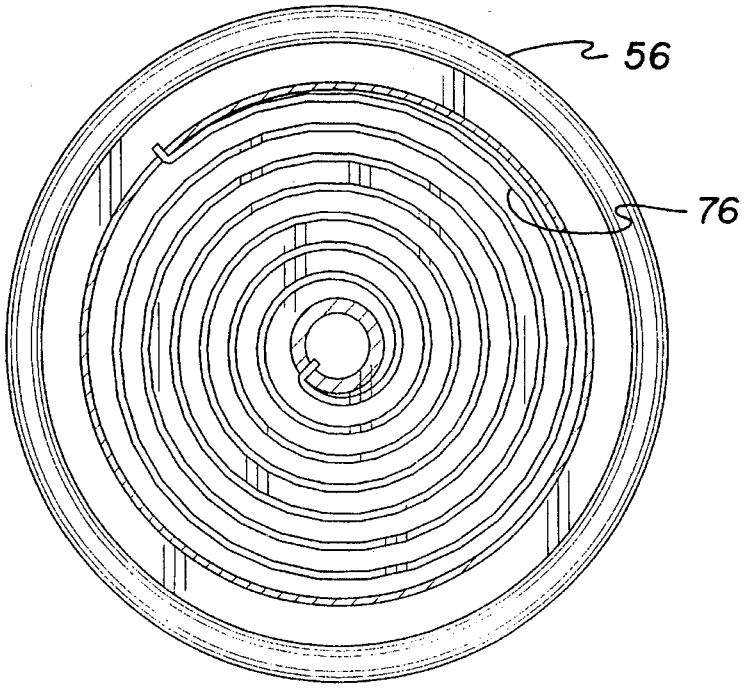
FIG. 5 is a cross sectional view taken along line 5—5 of FIG. 4. The same reference numerals refer to the same parts throughout the various Figures.

With reference now to the drawings, and in particular to FIGS. 1 thereof, the preferred embodiment of the new and improved hose handling apparatus with self-coiling capabilities embodying the principles and concepts of the present invention and generally designated by the reference numeral 10 will be described.

The present invention, the new and improved hose handling apparatus with self-coiling capabilities is a system 10 comprised of a plurality of components. Such components, in their broadest context, include a box, side plates, base plates, apertures, a spindle, a spring and an aperture. Each of the individual components is specifically configured and correlated one with respect to the other so as to attain the desired objectives.

The present invention is a system 10 having as its central component a box 12. Such box has an upper horizontal plate 14. The plate is in a rectangular configuration. It has parallel long side edges 16. It also has a short front edge 18 and a parallel short rear edge 20.

Next provided are a pair of parallel vertical side plates 24. Such side plates extend downwardly from the side edges of the upper plate at right angles with respect thereto.

Front and rear vertical walls 28, 40 are next provided. They extend downwardly from the front edge and the rear edge of the upper plate. Together the upper plate with the side plates and front and rear plates form a three-dimensional box-like configuration.

At the bottom of the box are four trapezoidal shaped base plates 44. Such base plates extend outwardly at an angle from the lower edges of the side, front and rear plates. Such trapezoidal shaped base plates provide stability to the rectangular box during operation and use.

Formed in a central extent of the side plates are a pair of apertures 48, 50. The apertures of the pair are circular and are axially aligned one with respect to the other. Located within the box and supported by the box is a spindle 54. The spindle has a pair of spaced aligned disk-shaped shoulders 56, 58. A hollow core 60 is located between the shoulders. In addition, a projecting short tube 62 extends from one end of the spindle and is rotatably mounted in one of the aligned apertures. In addition, a projecting long tube extends from the other end of the spindle and is rotatably mounted in the other of the axial apertures. In this manner, the spindle along with the shoulders and tubes are journaled within the housing for rotation with respect to the housing.

The long tube has a rotatable bearing 66. Such bearing includes threads 68 at its outboard end. Such threads are for coupling with a source of water such as a hose with a threaded coupling. Additional coupling components 70 are located at the inboard end for being coupled to a hose 72 which is rotatably mounted on the core of the spindle.

Greater facility is provided by the apparatus of the present invention by the use of a coil spring 76. Such coil spring is mounted around the short tube. It functions to couple at one end of the spring the adjacent shoulder in which it is pinned with coupling to the short tube through the end of the spring pinned therein. The spring functions to resiliently urge the spindle, core and the hose thereon, to the wound orientation when a user releases the hold on the hose.

Lastly provided is a rectangular aperture 80. Such aperture is formed in the front wall. It includes a pair of spaced rollers 82. The rollers are spaced a distance for the hose of the spindle to extend therethrough. Since the space is sufficiently small so that a nozzle on the free end of the hose will not pass into the box through the space between the rollers. The rollers are for guiding the movement of the hose between the spindle and exterior thereof.

A self-contained garden hose carrier for ease in transporting and rolling out hose. This item automatically winds up and back into the carrier when finished.

This storage unit is constructed from durable, hard plastic. All other parts are made from rust-resistant materials. It is green in color, similar to many garden tools and wheelbarrows. Four wheels are easily folded up and out of the way when not being used. It measures approximately three feet in height and width. The inner mechanism is a long coiled piece of sheet metal. It operates much like the spring in a tape measure and coils and uncoils similarly. The item is complete with hose, variable lengths dependent on size purchase, hose connections, and adjustable spray gun.

To operate, the owner sets the cart next to the water source and hooks one end of the hose to an outdoor faucet. The water is turned on and remains on because a valve on the cart may now be employed. Once ready, the user takes the spray gun out of its holder and pulls firmly on the hose to uncoil it. Bring it to the desired location and employ the adjustable spray nozzle. When finished with the task, release it and allow it to roll back inside the holder.

This is a convenient and practical solution to the cumbersome hand rolling and unrolling of a standard garden hose. Gardeners and yard workers can now quickly access the hose and have it picked up and put away in very little time.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved hose handling apparatus with self coiling capabilities comprising, in combination:

a box having an upper horizontal plate in a rectangular configuration having parallel long side edges and a short front edge and a parallel short rear edge;

a pair of parallel vertical side plates extending downwardly from the side edges of the upper plate;

front and rear vertical plates extending downwardly from the front and rear edges of the upper plate;

four trapezoidal shaped base plates extending outwardly at an angle from the lower edges of the side, front and rear plates to provide stability to the box;

a pair of axially aligned circular apertures formed in a central extent of the side plates;

a spindle having an axis and having a pair of spaced aligned disk-shaped shoulders and a hollow core therebetween and with a projecting short tube extending from one end of the spindle rotatably mounted in one of the aligned apertures and with a projecting long tube extending from the other end of the spindle rotatably mounted in the other of the aligned apertures to journal the spindle within the housing;

the long tube having a rotatable bearing with threads at its outboard end for coupling with a source of water and having coupling components at its inboard end for being coupled to a hose mounted on the core;

a coil spring around the short tube coupling the adjacent shoulder with the short tube and resiliently urging the spindle core and a hose thereon to a wound orientation, the coil spring having an axis, the axis of the coil spring being coincident with the axis of the spindle; and a rectangular aperture formed in the front wall with a pair of spaced rollers for guiding the movement of a hose between the spindle and exterior thereof.

* * * * *